US005863692A

United States Patent [19]

Nakamura et al.

[11] Patent Number: 5,863,692

[45] Date of Patent: Jan. 26, 1999

[54] TONER FOR ELASTROSTATIC LATENT IMAGE DEVELOPING AND METHOD OF MANUFACTURING SAME

[75] Inventors: Akihiro Nakamura, Osaka; Katsuji Nagasawa, Nara-Ken; Yutaka Tsujishita, Takarazuka; Kinya Sonoda, Kobe, all of Japan

[73] Assignee: Minolta Co., Ltd., Osaka, Japan

[21] Appl. No.: 917,701

[22] Filed: Aug. 26, 1997

[30] Foreign Application Priority Data

Sep. 10, 1996 [JP] Japan ..... 8-239090

[51] Int. Cl.[6] ..... G03G 9/097

[52] U.S. Cl. ..... 430/110; 430/111; 430/137

[58] Field of Search ..... 430/106, 110, 430/109, 137, 111

[56] References Cited

U.S. PATENT DOCUMENTS

| | | | |
|---|---|---|---|
| 4,767,688 | 8/1988 | Hashimoto et al. | 430/110 |
| 5,272,034 | 12/1993 | Kawano, et al. | 430/137 |
| 5,538,829 | 7/1996 | Ong et al. | 430/106 |
| 5,607,803 | 3/1997 | Murofushi et al. | 430/109 |

FOREIGN PATENT DOCUMENTS

| | | |
|---|---|---|
| 01306861 | 11/1989 | Japan . |
| 03063664 | 3/1991 | Japan . |
| 03112990 | 5/1991 | Japan . |

*Primary Examiner*—John Goodrow
*Attorney, Agent, or Firm*—McDermott, Will & Emery

[57] ABSTRACT

The present invention relates to a toner comprising toner particles which include at least a colorant, a binder resin, particles of metal oxide having a BET specific surface area of 80~300 $m^2/g$, and an organic boron compound represented by the structural formal (I) below.

(I)

(Where Z is a residue forming a ring with an adjacent oxygen atom and carbon atom, X is a cation, and n is an integer of either 1 or 2.) The present invention further relates to a method of manufacturing a toner comprising a process of mixing at least a colorant, a binder resin, particles of metal oxide having a BET specific surface area of 80~300 $m^2/g$, and an organic boron compound represented by the structural formal (I); a process of melting and kneading the obtained mixture; a process of cooling the kneaded mixture; a process of pulverizing said mixture to produce particles having a predetermined particles size; and a process of classifying said pulverized particles to obtain toner particles which are removed undesired small toner particles.

40 Claims, No Drawings

TONER FOR ELASTROSTATIC LATENT IMAGE DEVELOPING AND METHOD OF MANUFACTURING SAME

BACKGROUND OF THE INVENTION

1. Field of the Invention

The present invention relates to a toner for developing electrostatic latent images and method of manufacturing same.

2. Description of the Related Art

Heretofore, monocomponent developing methods and two-component developing methods have been used as electrostatic latent image developing methods. In both methods toner is charged and delivered by electrostatic force to develop an electrostatic latent image. Disadvantages arise in these methods, however, insofar as when the toner is inadequately charged, not only is the amount of toner charge reduced, but toner possessing an opposite charge is also generated, leading to toner adhesion in non-image regions which causes fog in the produced image.

For this reason, charge controllers are conventionally added to toner to impart desired triboelectric charging characteristics to said toner. Various useful charge controllers include nigrosine dyes, quaternary ammonium salts, monoazo complex with chromium, salicylic acid complex with chromium and the like. Although toners which include the aforesaid charge controllers initially exhibit excellent charging characteristics, these characteristics are reduced after repeated use and result in other disadvantages such as filming and fogging.

Japanese Laid-Open Patent Application Nos. 1-306861, 3-63664, and 3-112990 disclose measures to eliminate the previously described disadvantages by using organic boron compounds as charge controllers. These compounds are advantageous in that they have excellent heat stability, are colorless, or effectively appear colorless in color tone, and are therefore suitable for use in color toners.

When manufacturing toners containing organic boron compounds by kneading pulverization methods, however, disadvantages arise insofar as the mixture is subjected to severe temperature elevation even when cooled during mixing by cooling the mixing machine (e.g., Henschel mixer) while processing the material prior to kneading. When the temperature of the mixture exceeds a constant temperature, the binding resin becomes molten and is difficult to remove from the mixing device, such that remixing is required after mixing must be stopped and the mixture adequately cooled. A disadvantage therefore arises insofar as production characteristics are markedly reduced. Inadequate mixing results when the mixing time is shortened and the mixing process ended before temperature elevation occurs. When the material is inadequately mixed, a mixture containing a uniform dispersion of constituent materials cannot be obtained, and further disadvantages arise insofar as the toner obtained when this mixture is pulverized and classified after fusion kneading causes filming and fogging.

From the perspectives of consumption of raw materials, environmental characteristics, and economics of manufacturing toner by the aforesaid kneading pulverization method, U.S. Pat. No. 5,272,034 proposes the recovery of undesired toner powder produced by the pulverization and/or classification processes (i.e., fine toner particles excluded from the commercial toner) and adding this toner powder to the material in the mixing process as reusable toner material. When toner powder is added to the material being mixed, said toner powder normally works as a buffering agent which makes it difficult for the temperature of the mixture to become elevated, but in the case of organic boron compounds, the addition and mixing of toner powder causes the aforesaid disadvantages to occur as a result of a marked rise in temperature of the mixture.

SUMMARY OF THE INVENTION

An object of the present invention is to provide a toner that does not cause filming or fogging.

Another object of the present invention is to provide a toner having excellent production characteristics.

A further object of the present invention is to provide a method of manufacturing a toner which does not cause filming or fogging and has excellent production characteristics.

The present invention relates to a toner for electrostatic latent image developing comprising toner particles including at least a colorant, a binder resin, particles of metal oxide having a BET specific surface area of 80~300 $m^2/g$, and an organic boron compound represented by the structural formal (I) below.

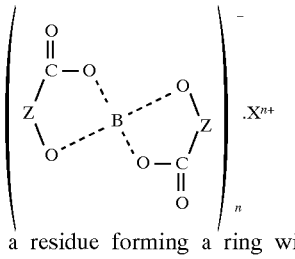

(I)

(Where Z is a residue forming a ring with an adjacent oxygen atom and carbon atom, X is a cation, and n is an integer of either 1 or 2.)

The present invention further relates to a method of manufacturing a toner for developing electrostatic latent images comprising:

a process of mixing at least a colorant, a binder resin, particles of metal oxide having a BET specific surface area of 80~300 $m^2/g$, and an organic boron compound represented by the structural formal (I) below;

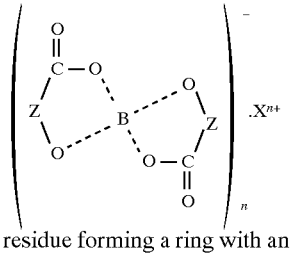

(I)

(where Z is a residue forming a ring with an adjacent oxygen atom and carbon atom, X is a cation, and n is an integer of either 1 or 2);

a process of melting and kneading the obtained mixture;

a process of cooling the kneaded mixture;

a process of pulverizing said mixture to produce particles having a predetermined particles size; and a process of classifying said pulverized particles to obtain toner particles which are removed undesired small toner particles.

DETAILED DESCRIPTION OF THE INVENTION

The present invention pertains to toner particles including at least binder resin, colorant, and organic boron compound having the aforesaid structural formula (I), and which has an internal additive of metal oxide particles. This composition improves flow characteristics of the mixture during the mixing process so as to allow production of a mixture within a desired temperature range. As a result, adhesion of the mixture is avoided during the mixing process, thereby improving transportability of the obtained mixture to the next process so as to improve production characteristics. Furthermore, dispersibility of the aforesaid materials contained in the toner particles is improved by obtaining a desired mixture, thereby eliminating the disadvantages of filming and fogging.

The present invention is particularly useful as a negative charge controller for toner using organic boron compound having the aforesaid structural formula (I) which causes a marked temperature elevation when mixing the material prior to kneading.

In the present invention, the compound comprising the previously mentioned residue Z having the structural formula shown below in an organic boron compound having the aforesaid structural formula (I) is particularly effective from the perspective of toner charging characteristics.

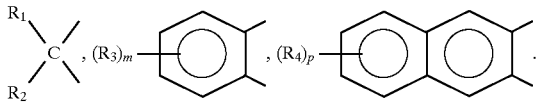

In the structural formula above, R1 represents a hydrogen atom, alkyl group, substituted or non-substituted aryl group; R2 represents a substituted or non-substituted aryl group; R3 represents a hydrogen atom, alkyl group, or aryl group, and m represents an integer of 1 to 4; and R4 represents a hydrogen atom, alkyl group, or aryl group, and p is an integer of 1 to 4.

The anion of the organic boron compound having the structural formula (I) may be an anion such as the examples shown below.

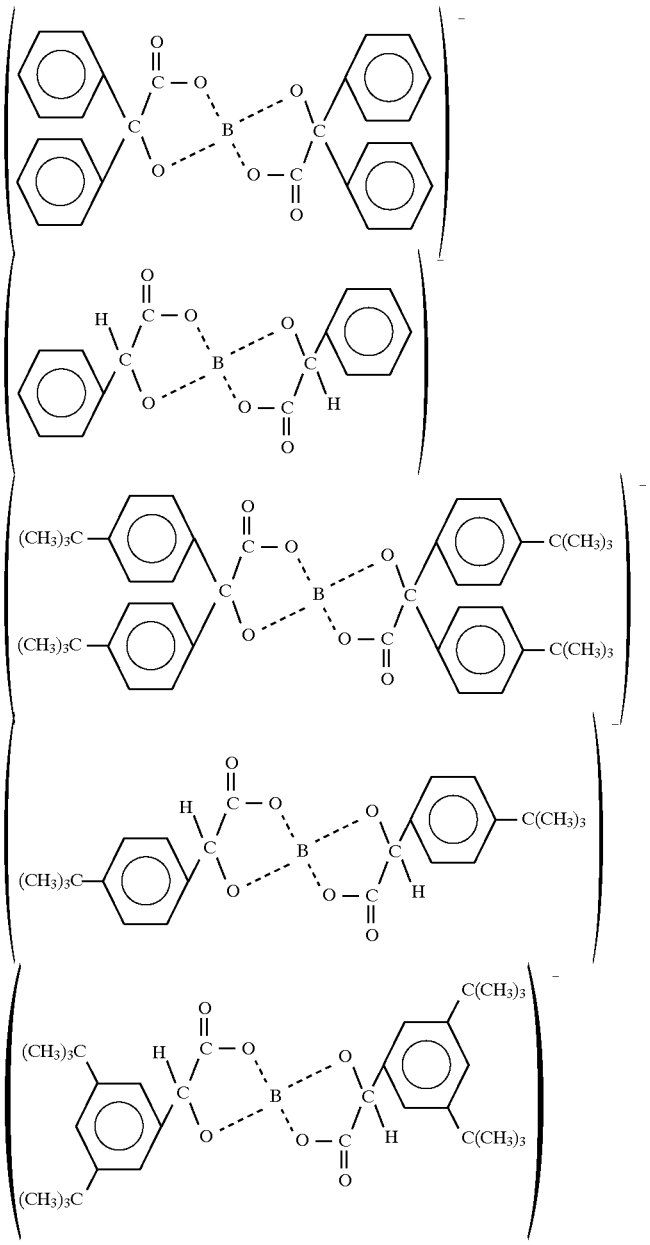

-continued
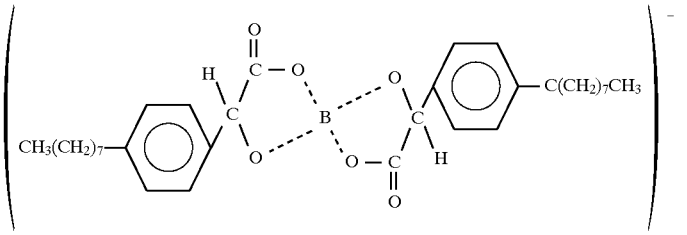
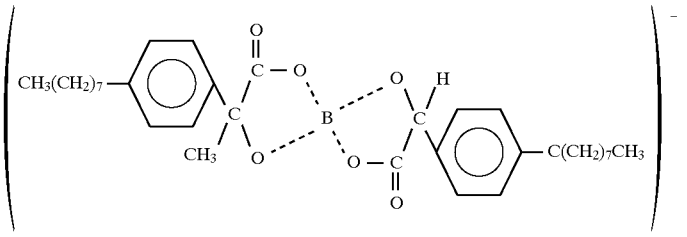
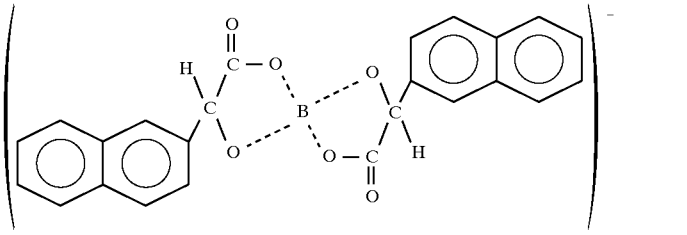
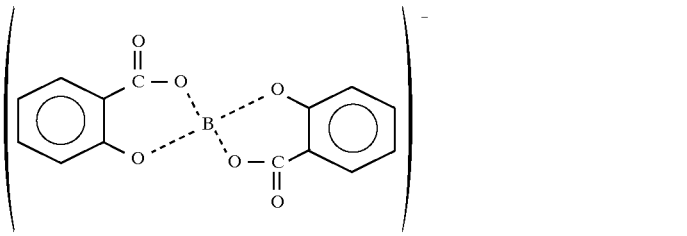
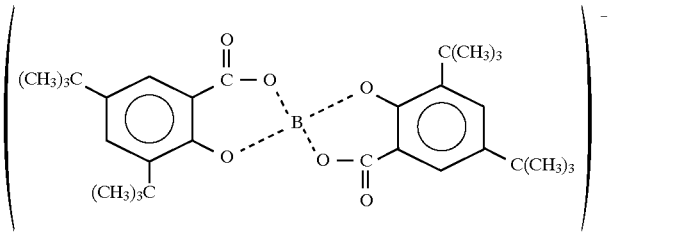
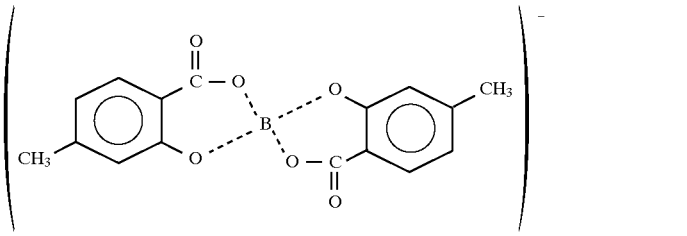
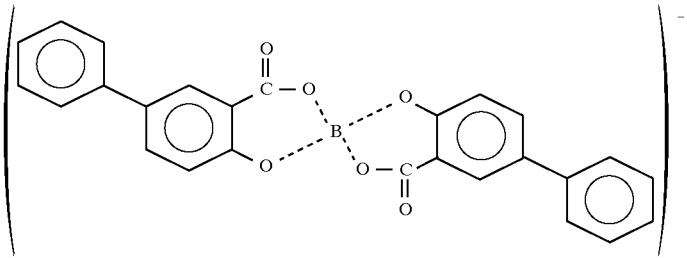

-continued

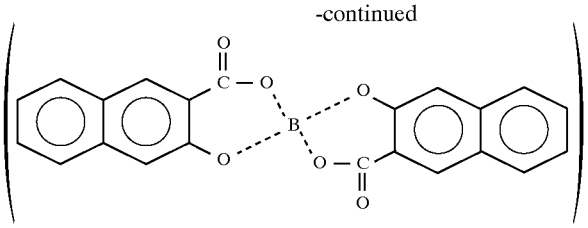

Examples of the cation expressed by the symbol X in the aforesaid organic boron compound may be inorganic cations such as $H^+$, $Li^+$, $Na^+$, $k^+$, $Mg^{2+}$, $Ca^{2+}$, $Zn^{2+}$ and the like, or organic cations such as ammonium ion, iminium ion, phosphonium ion and the like. Specific examples of organic cations are given below.

$[NH_4]^+$, $[(CH_3)_2NH_2]^+$, $[(C_2H_5)_2NH_2]^+$, $[(C_2H_5)_3NH]^+$, [( 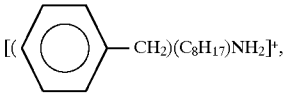 $CH_2)(C_8H_{17})NH_2]^+$,

[ 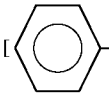 $CH_2N(CH_3)_3]^+$, $[(C_6H_5)N(CH_3)_3]^+$

Organic boron compounds useful in the present invention may be combinations of the previously mentioned anions and cations. The amount of added organic boron compound is desirably 0.5 to 10 parts-by-weight relative to 100 parts-by-weight of binder resin (hereinafter "parts-by-weight" is abbreviated to "pbw").

In the present invention, metal oxide particles are added within the toner particles to eliminate the drawback of exothermic heat generation by compounds containing organic boron compound during the mixing process. That is, the aforesaid drawback is eliminated by dispersing metal oxide particles and organic boron compound within the toner particles.

Usable metal oxide particles added within the toner particles in the present invention will have a BET specific surface area of 80~300 $m^2/g$, and preferably 100~280 $m^2/g$. When the BET specific surface area is less than 80 $m^2/g$, there is reduced effectiveness in preventing temperature elevation during the mixing process. When the BET specific surface area exceeds 300 $m^2/g$, there is an undesirable concern of reduced environmental stability of the toner. Examples of usable metal oxide particles include silica, titania, alumina and the like. It is desirable that such metal oxide particles are subjected to surface processing by a hydrophobic agent. It is particularly desirable to use metal oxide particles having a hydrophobicity of 30% or greater, and preferably 40% or greater. Exothermic heat generation is suppressed when mixing the raw materials and dispersibility of charge controllers is improved without loss of environmental stability by using the aforesaid hydrophobic metal oxide particles. The degree of hydrophobicity may be measured using a methanol wettability method. That is, Methanol is titrated in an aqueous solution containing a suspension of dispersed sample material, and the weight of methanol required to saturate and precipitate out all sample material is measured; the degree of hydrophobicity is expressed as the percentage methanol weight in the water/methanol solution at this time.

Examples of hydrophobic agents useful for the surface processing of the metal oxide particles include silane coupling agents, titanate coupling agents, silicone oils, silicone varnishes and the like. Examples of useful silane coupling agents include hexamethyldisilazane, trimethylsilane, trimethylchlorosilane, dimethyldichlorosilane, methyltrichlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxy silane, vinyltriacetoxysilane and the like. Examples of useful silicone oils include dimethylpolysiloxane, methylhydrozinepolysiloxane, methylphenylpolysiloxane and the like.

The amount of metal oxide particles added in the toner particles is desirably 0.05 pbw or more, preferably 0.05~3.0 pbw, and more preferably 0.1~1.0 pbw relative to 100 pbw of binder resin. When the amount of added metal oxide particles is less than 0.05 pbw, the previously described effectiveness is not achieved. When an excessive amount of metal oxide particles is added, there is concern said additive may influence toner particle chargeability and fixing characteristics.

Well known binder resins may be used as the binder resin in the toner of the present invention. Examples of useful binder resins include styrene resins, acrylic resins such as alkylacrylate and alkylmethacrylate and the like, as well as styrene-acrylic copolymer resins, polyester resins, epoxy resins, silicone resins, olefin resins, amide resins and the like used either individually or in combination.

The binder resin used in full color toners in the present invention, i.e., cyan toner, magenta toner, yellow toner, and black toner, will have a number-average molecular weight (Mn) of 3,000~6,000, and preferably 3,500~5,500, a weight-average molecular weight (Mw) to number-average molecular weight ratio Mw/Mn of 1~8, and preferably 2~6, a glass transition temperature of 50°~75° C., and preferably 55°~70° C., and a softening point of 90°~115° C., and preferably 90°~110° C. When the number-average molecular weight of the binder resin is less than 3,000, the image region readily separates from the sheet when a full color solid image is folded, so as to produce image defects (i.e., lowered fold-fixing characteristics). When the number-average molecular weight exceeds 6,000, the thermal fixing characteristics are reduced so as to reduce fixing strength. When the ratio Mw/Mn is less than 1, high temperature offset readily occurs. When the ratio Mw/Mn exceeds 8, the sharp melt characteristics are lowered during fixing, so as to cause reductions in toner light transmittancy and color mixing during full color image formation. Furthermore, when the glass transition temperature is less than 50° C., the toner possesses inadequate heat resistance, and toner flocculation readily occurs during storage. When the glass transition temperature is higher than 75° C., fixing characteristics are lowered and color mixing is reduced when forming full color images. When the softening temperature is less than 90° C., high temperature offset readily occurs, whereas when the softening temperature is greater than 115° C., fixing strength, transmittancy, color mixing, and full color image glossiness are reduced. A polyester resin is desirable for use as the binder resin in a negatively charged toner.

Well known resins may be used as the colorant in toner of the present invention, and are not particularly restricted. The dispersibility of colorants used in the color toners can be improved by master batch processing or a flashing process. The amount of colorant content is desirably 2~15 pbw relative to 100 pbw of binder resin.

The toner of the present invention is manufactured by a kneading pulverization method comprising a process of mixing at least the aforesaid binder resin, colorant, organic boron compound, and metal oxide particles, a process of fusion kneading of the obtained mixture, a process of pulverizing the obtained kneaded material after cooling, and a process of classifying the pulverized particles to obtain toner particles.

In the aforesaid material mixing process, pulverization and mixing of a binder resin is accomplished using a mixing device utilizing a shearing force such as generated by a Henschel mixer or the like. The colorant and organic boron compound and the like are dispersed and mixed by the stress generated when the binder resin is pulverized. In this mixing process, the temperature of the mixture is gradually raised in conjunction with the mixing time to pulverize the binder resin, and this temperature rise is particularly rapid when the aforesaid organic boron compound is used as a charge controller as previously described. Since metal oxide particles are added to the other constituents in the present invention, however, the flow characteristics of the mixture are improved so as to make it possible to accomplish mixing within a desired temperature range and avoid adhesion of the mixture, improve transportability to the subsequent fusion kneading process, and thereby improve production characteristics. Furthermore, excellent chargeability is obtained due to the improved dispersibility of the various materials, and particularly the organic boron compound, contained within the toner particles by accomplishing a desired mix. In the mixing process, wax, magnetic powder or the like may be used as additional additives. From the perspective of economy, it is desirable to recover undesired toner powder generated by removing from toner particles for product in the toner manufacturing process, i.e., pulverization and/or classification processes, for reuse in the mixing process.

The aforesaid material mixing process may use a method of batch mixing of all materials, or a method of mixing various materials in stages. It is desirable that the recovered toner powder is mixed after mixing the other materials. The reason for this is that materials such as colorant and organic boron compound must be uniformly dispersed, and if the toner powder is simultaneously added with said materials, the toner powder works as a buffer agent due to the extremely small size of the toner particles, so as to mitigate the stress applied by the binder resin particles on the other materials such as colorant and organic boron compound and the like. Therefore, when adding toner powder, it is desirable that mixing is accomplished in two stages, i.e., the binder resin, colorant, and organic boron compound are mixed in a first mixing process, and said toner powder and metal oxide particles are mixed in a second mixing process. Alternatively, mixing may be accomplished in two stages, i.e., the binder resin and organic boron compound are mixed in a first mixing process, and the mixture obtained in said first process is mixed with colorant, toner powder, and metal oxide particles in a second mixing process. The temperature of the mixture during the material mixing process (i.e., the temperature measured by a temperature sensor provided on a baffle plate of the Henschel mixer) is desirably a temperature 15° C. below the glass transition temperature of the binder resin, based on experiments. When the mixture temperature is higher than the aforesaid temperature, the temperature within the mixture may rise higher than the glass transition temperature of the binder resin, so as to cause adhesion of the mixture and prevent the effect of the present invention from being realized.

The mixture obtained by the aforesaid mixing process is subjected to a fusion kneading process, then the obtained kneaded material is cooled and subsequently transported to a pulverization process. In the fusion kneading process, a single-shaft extrusion kneader or twin-shaft extrusion kneader may be used to fuse the binder resin and constituents compatible with same, and uniformly disperse in the binder resin the constituents that are not compatible with the binder resin. After pulverization, the pulverized material is classified to obtain toner particles having a volume-average particle size of 5~10 μm, and preferably 6~9 μm. When the particle size is less than 5 μm, it is difficult to manage the material within the image forming apparatus, whereas high-resolution reproducibility is reduced when the particle size exceeds 10 μm. In order to obtain a desired toner particle size in the pulverization process, it is desirable that the material is subjected to fine pulverization using a jet mill following coarse pulverization using a feather mill or the like.

The toner powder generated by the aforesaid pulverization and/or classification processes is a powder having a fine particle size of less than 4 μm, which is an extremely small particle size compared to the binder resin premixing particle size (about 1,000 μm). Particularly fine toner powder is generated in conjunction with producing the fine particle size toner required for high-resolution image reproduction. Although the mixability of the other constituents is reduced and the toner powder adhesion characteristics are increased due to the organic boron compound contained in the toner powder and the large difference in particle size of the binder resin, the present invention is markedly effective in improving dispersibility when reusing toner powder.

In order to improve the flow characteristics, environmental stability and the like of the toner particles obtained via the aforesaid processes, it is desirable that the particles have added to their exterior metal oxide particles having a BET specific surface area of 10~300 $m^2/g$, and preferably 20~280 $m^2/g$.

From the perspective of improving flow characteristics, metal oxide particles having a BET specific surface area of 100~300 $m^2/g$, and preferably 120~250 $m^2/g$, and hydrophobicity of 30% or higher, and preferably 40% or higher, are desirable. Such metal oxide particles are desirable from the standpoint of preventing reduction in the amount of toner charge under conditions of high temperature and high humidity, and the use of silica or titania metal oxide particles is particularly desirable. From the standpoint of improving environmental stability, and particularly preventing reduction of image density due to charge increases under conditions of low temperature and low humidity, metal oxide particles having a BET specific surface area of 10~100 $m^2/g$, and preferably 20~90 $m^2/g$, and hydrophobicity of 30% or higher are desirable. Titania is particularly desirable for use as such metal oxide particles. The total amount of metal oxide microparticle additive in the toner particles having the aforesaid metal oxide particles added to their exterior surface is 0.1~3.0 percent-by-weight, and preferably 0.5~2.5 percent-by-weight. When the amount of added metal oxide particles is less than 0.1 percent-by-weight, the additive does not produce sufficient effectiveness, whereas when the amount of additive exceeds 3 percent-by-weight, there is an increase in the amount of metal oxide particles allowed to pass during blade cleaning, such that image noise is produced.

The aforesaid toner maintains excellent chargeability over repeated use. The aforesaid toner has excellent dispersion characteristics of the constituent materials in the toner particles as well as excellent production characteristics, and when using the organic boron compound does not produce filming or fogging.

The toner of the present invention may be mixed with a carrier for use as a two-component developer, or may be used without a carrier as a monocomponent developer. It is particularly desirable for use as a non-magnetic color toner.

The present invention is described in detail hereinafter by way of specific examples.

EXAMPLES

Polyester Resin A

A 5-liter capacity four-mouth flask was provided with a reflux condenser, moisture separator, nitrogen gas tube, thermometer, and mixing device, and the flask was placed in a mantle heater. Introduced to this flask were polyoxypropylene(2,2)-2,2-bis(4-hydroxyphenyl)propane (PO), polyoxyethylene(2,0)-2,2-bis(4-hydroxyphenyl) propane (EO), and terephthalic acid (TPA) at a molar ratio of 3:7:9 (PO:EO:TPA). A reaction was induced by heating and mixing the materials as nitrogen gas was introduced to the flask via the nitrogen gas tube. The acid value of the material was measured during the course of the reaction and the reaction was terminated when a predetermined acid value was attained to obtain a polyester resin A. This resin had a glass transition temperature Tg of 65° C., number-average molecular weight Mn of 4,700, Mw/Mn ratio of 3, and a softening point Tm of 100° C.

The number-average molecular weight Mn and the weight-average molecular weight Mw of the polyester resin was measured by the use of a gel permeation chromatography (807-IT made by Nihon Spectrum Industries Ltd.). The softening point Tm of the polyester resin was measured by the use of a flow tester (CFT-500 made by Shimadzu Corporation). The glass transition temperature Tg of the polyester resin was measured by the use of a differential scanning calorimeter (DSC-200 made by Seiko Electronics Co. Ltd.).

Pigment Master Batch Preparation

A mixture of polyester resin A (Tg=65° C., Mn=4700, Mw/Mn=3, Tm=100° C.) and cyan pigment (C.I.Pigment Blue 15-3, made by Toyo Ink Mfg.) was prepared at a weight ratio of 7:3 (polyester resin A:cyan pigment). This mixture was introduced to a pressure kneader and mixed under heat and pressure to achieve adequate dispersion of the pigment. The mixture was then cooled, and pulverized in a feather mill to obtain a pigment master batch.

Example 1

A mixture comprising 80 pbw of polyester resin A (Tg=65° C., Mn=4700, Mw/Mn=3, Tm=100° C.), 20 pbw of the aforesaid pigment master batch, and 2 pbw of negative charge controller (organic boron compound having the chemical structural formula (II) below) was introduced into the Henschel mixer cooled by a coolant flow through the mixer jacket of about 10° C. The resin and various materials were mixed in the Henschel mixer for one minute to achieve a uniform mixture (first mixing process). The temperature of the materials in the Henschel mixer at this time was less than 50° C. (Tg−15° C.).

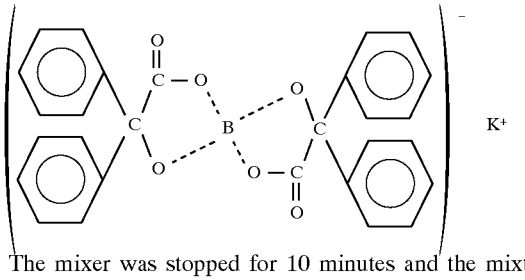

(II)

The mixer was stopped for 10 minutes and the mixture obtained in the first mixing process was cooled to about 30° C. To this mixture was then added 20 pbw of toner powder (powder produced in the pulverization and classification processes) and 0.2 pbw of hydrophobic silica (H-2000; made by Hoechst Co.; specific surface area=150 $m^2/g$, hydrophobicity=55%), and the materials were mixed again for 8 minutes (second mixing process). The temperature of the material in the Henschel mixer at this time was less than 50° C. (Tg−15° C.).

The mixture obtained in the second mixing process was introduced to a twin-shaft extrusion kneader and uniformly kneaded. After the kneaded material removed from the twin-shaft extrusion kneader was allowed to stand to adequately cool, the kneaded material was coarsely pulverized, finely pulverized, and classified to obtain toner particles having a mean particle size of 8.5 $\mu$m. After these toner particles were subjected to surface processing by adding and mixing 0.3 percent-by-weight of hydrophobic silica (H-2000; made by Hoechst Co.; specific surface area=150 $m^2/g$, hydrophobicity=55%), the resulting toner particles were subjected to further surface processing by adding and mixing 0.2 percent-by-weight of hydrophobic titanium (T-805, Nippon Aerosil K.K.; specific surface area=35 $m^2/g$, hydrophobicity=55%) to obtain toner A.

Example 2

Toner B was produced in the same manner as described in Example 1 with the exception that 0.3 pbw hydrophobic silica was added in the second mixing process.

Example 3

Toner C was produced in the same manner as described in Example 1 with the exception that 0.1 pbw hydrophobic silica was added in the second mixing process.

Example 4

Toner D was produced in the same manner as described in Example 1 with the exception that the materials used in the first mixing process and second mixing process were batch mixed for 5 minutes.

Example 5

A mixture comprising 100 pbw of polyester resin A (Tg=65° C., Mn=4700, Mw/Mn=3, Tm=100° C.), and 2 pbw of negative charge controller (organic boron compound having the chemical structural formula (II) above) was introduced into the Henschel mixer cooled by a coolant flow through the mixer jacket of about 10° C., and mixed for 1 minute to uniformly disperse the charge controller (first mixing process). The temperature of the materials in the Henschel mixer at this time was less than 50° C. (Tg−15° C.).

The mixer was stopped for 10 minutes and the mixture obtained in the first mixing process was cooled to about 30° C. To this mixture was then added 7 pbw of carbon black (MA#8, Mitsubishi Kagaku Kogyo K.K.), 20 pbw of toner powder (powder produced in the pulverization and classification processes) and 0.2 pbw of hydrophobic silica (R-972, Nippon Aerosil K.K.; specific surface area=110 $m^2/g$, hydrophobicity=35%), and the materials were mixed again for 8 minutes (second mixing process). The temperature of the material in the Henschel mixer at this time was less than 50° C. (Tg−15° C.).

The mixture obtained in the second mixing process was introduced to a twin-shaft extrusion kneader and uniformly kneaded, and after the kneaded material was allowed to stand to adequately cool, the kneaded material was coarsely pulverized, finely pulverized, and classified to obtain toner particles having a mean particle size of 8.3 $\mu$m. These toner particles were then subjected to surface processing by adding and mixing 0.5 percent-by-weight of hydrophobic silica (R-972, Nippon Aerosil K.K.; specific surface area=110 $m^2/g$, hydrophobicity=35%) to obtain toner E.

Reference Example 1

Toner F was produced in the same manner as described in Example 1 with the exception that hydrophobic silica was not added in the second mixing process, and mixing was stopped in the second mixing process before adequate mixing was achieved because the temperature of the materials exceeded 50° C. (Tg−15° C.) after mixing for 3 minutes.

Reference Example 2

Toner G was produced in the same manner as described in Example 1 with the exception that hydrophobic silica was not added in the second mixing process, and mixing was temporarily stopped in the second mixing process because the temperature of the mixed material exceeded 50° C. (Tg−15° C.) after mixing for 3 minutes; the material was allowed to cool to about 30° C., and mixing was started again. This alternating cooling and mixing was repeated to achieve a total mixing time of 8 minutes. The time required to complete this process was 1 hr 49 min, and adhesion of the mixture was observed on the walls of the Henschel mixer as was flocculation of the mixture. Thereafter the mixture was prepared in the same manner as in Example 1 to obtain toner G.

Reference Example 3

Toner H was produced in the same manner as described in Example 4 with the exception that hydrophobic silica was not added in the first mixing process, and mixing was temporarily stopped in the first mixing process because the temperature of the mixed material exceeded 50° C. (Tg−15° C.) after mixing for 3 minutes; the material was allowed to cool to about 30° C., and mixing was started again. This alternating cooling and mixing was repeated to achieve a total mixing time of 5 minutes. The time required to complete this process was 35 min, and adhesion of the mixture was observed on the walls of the Henschel mixer as was flocculation of the mixture. Thereafter the mixture was prepared in the same manner as in Example 1 to obtain toner H.

Reference Example 4

Toner I was produced in the same manner as described in Example 5 with the exception that hydrophobic silica was not added in the second mixing process, and mixing was temporarily stopped in the second mixing process because the temperature of the mixed material exceeded 50° C. (Tg−15° C.) after mixing for 3 minutes; the material was allowed to cool to about 30° C., and mixing was started again. This alternating cooling and mixing was repeated to achieve a total mixing time of 8 minutes. The time required to complete this process was 1 hr 55 min, and adhesion of the mixture was observed on the walls of the Henschel mixer as was flocculation of the mixture. Thereafter the mixture was prepared in the same manner as in Example 1 to obtain toner I.

Example 6

A mixture of 100 pbw of thermoplastic styrene-acrylic resin (Tg=64° C.), 2 pbw negative charge controller (organic boron compound having the structural formula (II) above), and 3.5 pbw carnuba wax (Kato Yoko, Co.) was introduced into a Henschel cooled by a coolant flow through the mixer jacket of about 10° C., and mixed for 1 minute to uniformly disperse the charge controller (first mixing process). The temperature of the materials in the Henschel mixer at this time was less than 49° C. (Tg−15° C.).

The mixer was stopped for 10 minutes and the mixture obtained in the first mixing process was cooled to about 30° C. To this mixture was then added 7 pbw of carbon black (MA#8, Mitsubishi Kagaku Kogyo K.K.), 20 pbw of toner powder (powder produced in the pulverization and classification processes) and 0.2 pbw of hydrophobic silica (H-2000, Hoechst Co.; specific surface area=150 $m^2/g$, hydrophobicity=55%), and the materials were mixed for 8 minutes (second mixing process). The temperature of the material in the Henschel mixer at this time was less than 49° C. (Tg−15° C.).

The mixture obtained in the second mixing process was introduced to a twin-shaft extrusion kneader and uniformly kneaded, and after the kneaded material was allowed to stand to adequately cool, the kneaded material was coarsely pulverized, finely pulverized, and classified to obtain toner particles having a mean particle size of 8.5 $\mu$m. These toner particles were then subjected to surface processing by adding and mixing 0.5 percent-by-weight of hydrophobic silica (H-2000, Hoechst Co.; specific surface area=150 $m^2/g$, hydrophobicity=55%), to obtain toner J.

Example 7

Toner K was produced in the same manner as described in Example 6 with the exception that the material used in the first mixing process and the second mixing process were batch mixed for 5 minutes.

Reference Example 5

Toner L was produced in the same manner as described in Example 6 with the exception that hydrophobic silica was not added in the second mixing process, and mixing was temporarily stopped in the second mixing process because the temperature of the mixed material exceeded 49° C. (Tg−15° C.) after mixing for 3 minutes; the material was allowed to cool to about 30° C., and mixing was started again. This alternating cooling and mixing was repeated to achieve a total mixing time of 8 minutes. The time required to complete this process was 1 hr 52 min, and adhesion of the mixture was observed on the walls of the Henschel mixer as was flocculation of the mixture. Thereafter the mixture was prepared in the same manner as in Example 6 to obtain toner L.

Reference Example 6

Toner M was produced in the same manner as described in Example 7 with the exception that hydrophobic silica was not added in the first mixing process, and mixing was temporarily stopped in the first mixing process because the temperature of the mixed material exceeded 49° C. (Tg−15° C.) after mixing for 3 minutes; the material was allowed to cool to about 30° C., and mixing was started again. This alternating cooling and mixing was repeated to achieve a total mixing time of 5 minutes. The time required to complete this process was 38 min, and adhesion of the mixture was observed on the walls of the Henschel mixer as was flocculation of the mixture. Thereafter the mixture was prepared in the same manner as in Example 6 to obtain toner M.

Print Resistance Test

Toners A~I were used in an electrophotographic type printer (improved model SP1000, Minolta Co., Ltd.; system speed: 35 mm/sec, modified with an oil application fixing device) provided with a nonmagnetic monocomponent developing device to print 6,000 continuous sheets. The toners were evaluated for filming on the photosensitive member surface and fog in printed images after 3,000 and 6,000 printings. Evaluation results are shown in Table 1 below. Evaluations were made according to the following rankings.

Filming of Photosensitive Member Surface

⊕: No filming

○: Slight filming which poses no practical problem

Δ: Partial fogging due to filming; a practical problem

X: Marked filming causing fog and reducing sensitivity of the photosensitive member Fog ○: No fog Δ: Partial fogging of printout; a practical problem X: Marked fog on printout

TABLE 1

| Example/ Reference Example | Toner | After 3,000 prints: Film on photosensitive member | After 3,000 prints: Fog | After 6,000 prints: Film on photosensitive member | After 6,000 prints: Fog | Time required for Mixing (min) |
|---|---|---|---|---|---|---|
| Ex 1 | A | ⊕ | ○ | ⊕ | ○ | 19 |
| Ex 2 | B | ⊕ | ○ | ⊕ | ○ | 19 |
| Ex 3 | C | ⊕ | ○ | ○ | ○ | 19 |
| Ex 4 | D | ⊕ | ○ | ⊕ | ○ | 5 |
| Ex 5 | E | ⊕ | ○ | ⊕ | ○ | 19 |
| Ref 1 | F | Δ | X | X | X | 14 |
| Ref 2 | G | ○ | Δ | X | X | 109 |
| Ref 3 | H | ○ | Δ | X | X | 35 |
| Ref 4 | I | ○ | Δ | X | X | 115 |

Toners J~M were adequately mixed and charged with pure carrier in a copier (Model EP8600, Minolta Co., Ltd.) and used to make 6,000 continuous copies. The toners were evaluated for filming on the photosensitive member surface and black spot fusion (BS) after 3,000 and 6,000 printings. Evaluation results are shown in Table 2 below. Evaluations were made according to the following rankings.

Filming of Photosensitive Member Surface

⊕: No filming

○: Slight filming which poses no practical problem

Δ: Partial fogging due to filming; a practical problem

X: Marked filming causing fog and reducing sensitivity of the photosensitive member Fog ○: No fog Δ: Black spots observed on photosensitive member surface, but not copy; poses no practical problem X: Marked fog on copy sheet

TABLE 2

| Example/ Reference Example | Toner | After 30,000 prints: Film on Photosensitive member | After 30,000 prints: BS | After 60,000 prints: Film on Photosensitive member | After 60,000 prints: BS | Time required for Mixing (min) |
|---|---|---|---|---|---|---|
| Ex 6 | J | ⊕ | ○ | ⊕ | ○ | 19 |
| Ex 7 | K | ⊕ | ○ | ○ | Δ | 5 |
| Ref 5 | L | Δ | Δ | X | X | 112 |
| Ref 6 | M | Δ | Δ | X | X | 38 |

The toner of the present invention clearly does not cause filming or fogging, and reduces the time required for the mixing process. In contrast, the toners of the reference examples exhibited a marked temperature rise during mixing due to the absence of the metal oxide particles within the toner particles, and achieved inadequate dispersion of other constituents within the toner particles despite the lengthy time required for the mixing process. When the required mixing time was reduced, filming and fogging were apparent for the aforesaid reasons.

What is claimed is:

1. A toner for developing electrostatic latent images comprising;

toner particles comprising a binder resin, a colorant, metal oxide particles having a BET specific surface area of from 80 to 300 $m^2/g$ and an organic boron compound, said metal oxide particles and said organic boron compound being dispersed in the toner particles said organic boron compound represented by a structural formula (I);

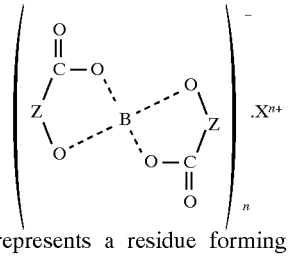

(I)

wherein Z represents a residue forming a ring with an adjacent oxygen atom and carbon atom, X represents a cation, and n represents an integer of either 1 or 2.

2. The toner of claim 1, wherein the metal oxide particles are treated by hydrophobic agent and a hydrophobicity of the treated metal oxide particles are 30% or more.

3. The toner of claim 1, wherein the metal oxide particles have the BET specific surface area of from 100 to 280 $m^2/g$.

4. The toner of claim 1, wherein the amount of the metal oxide particles is 0.05 parts by weight or more per 100 parts by weight of the binder resin.

5. The toner of claim 1, wherein the Z represents the residual group selected the group consisting of

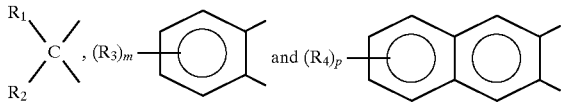

wherein R1 represents a hydrogen atom, an alkyl group or an aryl group, R2 represents an aryl group, R3 represents a hydrogen atom, an alkyl group or an aryl group, m represents an integer of 1 to 4, R4 represents a hydrogen atom, an alkyl group or an aryl group, and p represents an integer of 1 to 4.

6. The toner of claim 1, wherein the X represents an inorganic cation or an organic cation.

7. The toner of claim 1, wherein the amount of the organic boron compound is from 0.5 to 10 parts by weight per 100 parts by weight of the binder resin.

8. The toner of claim 1, wherein the binder resin is at least one resin selected from the group consisting of a styrene resin, an acrylic resin, a styrene-acrylic resin, a polyester resin, an epoxy resin, a silicone resin, an olefin resin and an amide resin.

9. The toner of claim 1, wherein the binder resin has a number average molecular weight Mn of from 3,000 to 6,000, a ratio of a weight average molecular weight Mw to the number 25 average molecular weight Mn (Mw/Mn) ranging from 1 to 8, a glass transition point of from 50° to 75° C. and a softening point of from 90° to 115° C.

10. A toner for developing electrostatic latent images comprising;

toner particles comprising a binder resin, a colorant, first metal oxide particles having a BET specific surface area of from 80 to 300 $m^2/g$ and an organic boron compound, said first metal oxide particles and said organic boron compound being dispersed in the toner particles, said organic boron compound represented by a structural formula (I);

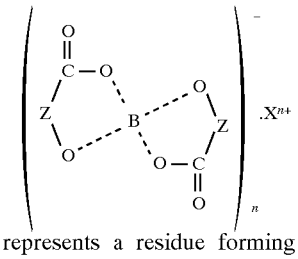

(I)

wherein Z represents a residue forming a ring with an adjacent oxygen atom and carbon atom, X represents a cation, and n represents an integer of either 1 or 2; and second metal oxide particles adhered to the surface of the toner particles and having a BET specific surface area of from 10 to 300 $m^2/g$.

11. The toner of claim 10, wherein the first metal oxide particles are treated by hydrophobic agent and a hydrophobicity of the treated metal oxide particles are 30% or more.

12. The toner of claim 10, wherein the first metal oxide particles have the BET specific surface area of from 100 to 280 $m^2/g$.

13. The toner of claim 10, wherein the amount of the first metal oxide particles is 0.05 parts by weight or more per 100 parts by weight of the binder resin.

14. The toner of claim 10, wherein the Z represents the residual group selected the group consisting of

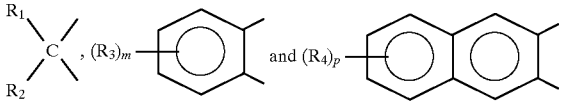

wherein R1 represents a hydrogen atom, an alkyl group or an aryl group, R2 represents an aryl group, R3 represents a hydrogen atom, an alkyl group or an aryl group, m represents an integer of 1 to 4, R4 represents a hydrogen atom, an alkyl group or an aryl group, and p represents an integer of 1 to 4.

15. The toner of claim 10, wherein the amount of the organic boron compound is from 0.5 to 10 parts by weight per 100 parts by weight of the binder resin.

16. The toner of claim 10, wherein the binder resin has a number average molecular weight Mn of from 3,000 to 6,000, a ratio of a weight average molecular weight Mw to the number average molecular weight Mn (Mw/Mn) ranging from 1 to 8, a glass transition point of from 50° to 75° C. and a softening point of from 90° to 115° C.

17. The toner of claim 10, wherein the second metal oxide particles are treated by hydrophobic agent and a hydrophobicity of the treated metal oxide particles are 30% or more.

18. The toner of claim 10, wherein the second metal oxide particles comprise the metal oxide particles having the BET specific surface area of from 100 to 300 $m^2/g$.

19. The toner of claim 10, wherein the second metal oxide particles comprise the metal oxide particles having the BET specific surface area of from 10 to 100 $m^2/g$.

20. The toner of claim 10, wherein the second metal oxide particles comprise two kind of the metal oxide particles having the different BET specific surface area.

21. The toner of claim 20, wherein the second metal oxide particles comprise the metal oxide particles having the BET specific surface area of from 20 to 90 $m^2/g$ and the metal oxide particles having the BET specific surface area of from 120 to 250 $m^2/g$.

22. The toner of claim 10, wherein the amount of the second metal oxide particles is from 0.1 to 3% by weight on the basis of the toner particles.

23. A method for manufacturing a toner for developing electrostatic latent images comprising steps of;

mixing a binder resin, a colorant, metal oxide particles having a BET specific surface area of from 80 to 300 $m^2/g$ and an organic boron compound represented by a structural formula (I);

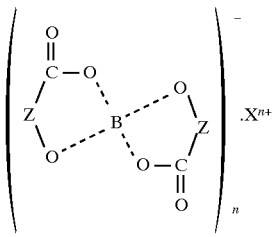

wherein Z represents a residue forming a ring with an adjacent oxygen atom and carbon atom, X represents a cation, and n represents an integer of either 1 or 2;

melting and kneading the obtained mixture;

cooling the kneaded mixture;

pulverizing the cooled mixture to produce particles having a predetermined particle size; and classifying said pulverized particles to remove undesired small toner particles.

24. The method of claim 23, which further comprises the step of mixing the toner particles with second metal oxide particles having a BET specific surface area of from 10 to 300 $m^2/g$.

25. The method of claim 23, wherein the mixing step comprises the step of mixing the binder resin, the colorant, the metal oxide particles, the organic boron compound and the small toner particles generated at the classifying step.

26. The method of claim 23, wherein the mixing step comprises a first mixing step and a second mixing step, said first mixing step comprising the step of mixing the binder resin, the colorant and the organic boron compound, and said second mixing step comprising the step of mixing the metal oxide particles and the mixture obtained by the first mixing step.

27. The method of claim 26, wherein the colorant comprising a masterbatch of a pigment.

28. The method of claim 26, wherein the second mixing step comprises the step of mixing the metal oxide particles, the mixture obtained by the first mixing step and the small toner particles generated at the classifying step.

29. The method of claim 23, wherein the mixing step comprises a first mixing step and a second mixing step, said first mixing step comprising the step of mixing the binder resin and the organic boron compound, and said second mixing step comprising the step of mixing the colorant, the metal oxide particles and the mixture obtained by the first mixing step.

30. The method of claim 29, wherein the second mixing step comprises the step of mixing the colorant, the metal oxide particles, the mixture obtained by the first mixing step and the small toner particles generated at the classifying step.

31. A toner for developing electrostatic latent images comprising;

toner particles comprising a binder resin, a colorant, metal oxide particles having a BET specific surface area of from 80 to 300 $m^2/g$ and an organic boron compound, said metal oxide particles and said organic boron compound being dispersed in the toner particles, and said organic boron compound represented by a structural formula (I);

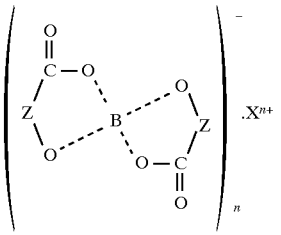

(I)

wherein X represents a cation, and n represents an integer of either 1 or 2, Z represents a residual group represented by;

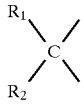

wherein R1 represents a hydrogen atom, an alkyl group or an aryl group, and R2 represents an aryl group.

32. The toner of claim 31, wherein the metal oxide particles are treated by hydrophobic agent and a hydrophobicity of the treated metal oxide particles are 30% or more.

33. The toner of claim 31, wherein the metal oxide particles have a BET specific surface area of from 100 to 280 $m^2/g$.

34. The toner of claim 31, wherein the binder resin has a number average molecular weight Mn of from 3,000 to 6,000, a ratio of a weight average molecular weight Mw to the number average molecular weight Mn (Mw/Mn) ranging from 1 to 8, a glass transition point of from 50° to 75° C. and a softening point of from 90° to 115° C.

35. The toner of claim 31, which comprises second metal oxide particles adhered to the surface of the toner particles, said second metal oxide particles having a BET specific surface area of from 10 to 300 $m^2/g$.

36. The toner of claim 35, wherein the second metal oxide particles are treated by hydrophobic agent and a hydrophobicity of the treated metal oxide particles are 30% or more.

37. The toner of claim 35, wherein the second metal oxide particles comprise metal oxide particles having a BET specific surface area of from 100 to 300 $m^2/g$.

38. The toner of claim 35, wherein the second metal oxide particles comprise metal oxide particles having a BET specific surface area of from 10 to 100 $m^2/g$.

39. The toner of claim 35, wherein the second metal oxide particles comprise two kind of the metal oxide particles having a different BET specific surface area.

40. The toner of claim 39, wherein the second metal oxide particles comprise metal oxide particles having a BET specific surface area of from 20 to 90 $m^2/g$ and metal oxide particles having a BET specific surface area of from 120 to 250 $m^2/g$.

* * * * *

UNITED STATES PATENT AND TRADEMARK OFFICE

CERTIFICATE OF CORRECTION

PATENT NO. : 5,863,692

DATED : January 26, 1999

INVENTOR(S) : Nakamura et al.

It is certified that error appears in the above-identified patent and that said Letters Patent is hereby corrected as shown below:

On the title page, Item [54] and Column 1, line 1,

In the Title:

Change "Elastrostatic" to "Electrostatic".

In the Claims:

Claim 9, column 17, line 32, delete "25".

Signed and Sealed this

First Day of June, 1999

*Attest:*

Q. TODD DICKINSON

*Attesting Officer*

*Acting Commissioner of Patents and Trademarks*